United States Patent [19]

Suzaki et al.

[11] Patent Number: 4,614,448

[45] Date of Patent: Sep. 30, 1986

[54] RIBBON CASSETTE CAM MEANS TO SELECTIVELY SEPARATE INK RIBBON FEED AND PINCH ROLLERS

[75] Inventors: Masayuki Suzaki, Fujisawa; Shoji Nishiwaki, Machida; Toshitaka Hayashima, Hatano, all of Japan

[73] Assignee: Ricoh Company, Ltd., Japan

[21] Appl. No.: 619,035

[22] Filed: Jun. 11, 1984

[30] Foreign Application Priority Data

Jun. 10, 1983 [JP] Japan ..... 58-103999
Jul. 29, 1983 [JP] Japan ..... 58-118199[U]

[51] Int. Cl.[4] ..... B41J 32/00

[52] U.S. Cl. ..... 400/208; 400/235.1

[58] Field of Search ..... 400/194, 195, 196, 196.1, 400/207, 208, 208.1, 234, 235, 235.1

[56] References Cited

U.S. PATENT DOCUMENTS

| | | | |
|---|---|---|---|
| 3,804,227 | 4/1974 | Cappotto et al. | 400/234 X |
| 4,033,445 | 7/1977 | Oddicini | 400/235.1 X |
| 4,131,372 | 12/1978 | Hengelhaupt | 400/196.1 |
| 4,213,715 | 7/1980 | Haftmann et al. | 400/207 X |
| 4,231,667 | 11/1980 | Behrendt et al. | 400/208 |
| 4,240,757 | 12/1980 | Hanna | 400/207 X |
| 4,293,234 | 10/1981 | Yonkers et al. | 400/196.1 |
| 4,397,574 | 8/1983 | Wojdyla | 400/196.1 |
| 4,413,919 | 11/1983 | Applegate et al. | 400/208 |
| 4,440,514 | 4/1984 | Keiter et al. | 400/208 |
| 4,446,790 | 5/1984 | Konkel et al. | 400/207 X |

FOREIGN PATENT DOCUMENTS

| | | | |
|---|---|---|---|
| 643701 | 6/1962 | Canada | 400/235.1 |
| 603257 | 9/1934 | Fed. Rep. of Germany | 400/194 |
| 0077180 | 6/1981 | Japan | 400/196.1 |
| 0155985 | 9/1983 | Japan | 400/196.1 |
| 1347636 | 2/1974 | United Kingdom | 400/196.1 |

OTHER PUBLICATIONS

IBM Technical Disclosure Bulletin, "Supply Spool Tensioning", Cahill, vol. 25, No. 8, Jan. 1983, pp. 4058–4059.

*Primary Examiner*—Ernest T. Wright, Jr.
*Attorney, Agent, or Firm*—Guy W. Shoup

[57] ABSTRACT

An ink ribbon feeding mechanism includes a rotatably supported capstan roller which is fixed in position and a rotatably supported pinch roller which is movable with respect to the capstan roller and normally biased toward the capstan roller to be pressed thereagainst with ink ribbon to be fed as being sandwiched therebetween. In the present invention, there is provided a structure which allows to keep the pinch roller separated away from the capstan roller when desired. In the preferred embodiment, it is so structured that the pinch roller is brought into contact with the capstan roller under pressure when a top cover is pivoted closed and brought out of contact with the capstan roller when the top cover is pivoted open, automatically.

7 Claims, 18 Drawing Figures

RIBBON CASSETTE CAM MEANS TO SELECTIVELY SEPARATE INK RIBBON FEED AND PINCH ROLLERS

BACKGROUND OF THE INVENTION

1. Field of the Invention

This invention relates generally to printers and particularly to an ink ribbon feeding mechanism in a printer. More specifically, the present invention relates to an ink ribbon cassette which is provided with an ink ribbon feeding mechanism and which can be detachably mounted in a printer.

2. Description of the Prior Art

An ink ribbon cassette housing therein ink ribbon for use in a printer as detachably mounted therein is well known in the art. Such an ink ribbon cassette is generally provided with a supply spool around which ink ribbon to be used for printing is wound and a take-up spool to which the ink ribbon is wound after having been used for printing. Thus, the ink ribbon is gradually fed from the supply spool to the take-up spool by an ink ribbon feeding mechanism. Such a typical prior art ink ribbon feeding mechanism is shown in FIGS. 1 and 2. As shown, upstream of a take-up spool 1 with respect to the feeding direction of ink ribbon 6 is disposed a capstan roller 2. Also disposed is a pinch roller 4 pressed against the capstan roller 2 by means of a spring 3. In the illustrated structure, the capstan roller 2 is rotatably supported by a stationary holder 2*a* which is fixedly mounted on an ink ribbon cassette 5, and the pinch roller 4 is rotatably supported by a movable holder 4*a* which is movably mounted on the cassette 5 in rolling contact under pressure with the capstan roller 2. The take-up spool 1 is also rotatably mounted on the cassette 5.

Typically, when the cassette 5 is set in position in a printer, the capstan roller 2 is operatively coupled to a driving shaft provided in the printer. Thus, as printing proceeds, the driving shaft rotates thereby causing the capstan roller 2 to rotate counterclockwise as indicated by the arrow so that the ink ribbon 6 pinched between the rollers 2 and 4 is fed toward the take-up spool 1 to be wound therearound. Although not shown specifically in FIG. 1, the printer is also provided with a mechanism for rotating the take-up spool 1 in association with the rotation of the capstan roller 2. Such a mechanism typically includes an endless belt extended between the capstan roller 2 and the take-up spool 1. Thus, the ink ribbon 6 can be immediately wound around the take-up spool 1 as fed by the rollers 2 and 4 without producing a slack.

As shown in FIG. 2, the cassette 5 includes a top cover 7 which is pivotally supported at a pivot 8 at each side, and, thus, the top cover 7 can be pivotally moved to open or close the cassette 5.

As described above, the capstan roller 2 is provided rotatably but fixed in position inside of the cassette 5; on the other hand, the pinch roller 4 is rotatably supported by the movable holder 4*a* which is movable with respect to the cassette 5 and normally biased toward the capstan roller 2 under the pressure of the spring 3. For this purpose, the movable holder 4*a* is typically so structured to be slidable on the bottom surface of the cassette 5. With this structure, when the cassette 5 is to be assembled or the ribbon 6 is to be replaced with new one, the pinch roller 4 must be moved away from the capstan roller 2 against the force of the spring 3 so as to place the ink ribbon 6 in position or to remove it therefrom. In this connection, it is often required to keep the pinch roller 4 away from the capstan roller 2 so as to facilitate positioning or removal of the ink ribbon 6, and, in this case, the operator's one hand must be used exclusively for this purpose. This is however disadvantageous because the operator must carry out the remaining operation with a single hand. For example, the ink ribbon 6 is relatively thin, typically 10 microns in thickness, and it is not easy to place such a thin ink ribbon around a guide 9 to the take-up spool 1 through the rollers 2 and 4 with one hand. In the case of an awkward operator, the ink ribbon 6 could be damaged.

SUMMARY OF THE INVENTION

It is therefore a primary object of the present invention to obviate the above-described disadvantages of the prior art and to provide an improved ink ribbon feeding mechanism.

Another object of the present invention is to provide an ink ribbon feeding mechanism which allows to carry out positioning or removal of ink ribbon easily as well as reliably.

A further object of the present invention is to provide an ink ribbon feeding mechanism which causes a pinch roller to be kept away from a capstan roller automatically when required.

A still further object of the present invention is to provide an ink ribbon cassette provided with a capstan roller and a pinch roller in which the pinch roller is moved away from or brought into pressure contact with the capstan roller automatically in association with the opening or closing of the cassette's top cover.

Other objects, advantages and novel features of the present invention will become apparent from the following detailed description of the invention when considered in conjunction with the accompanying drawings.

DESCRIPTION OF THE PREFERRED EMBODIMENTS

Figure 1:
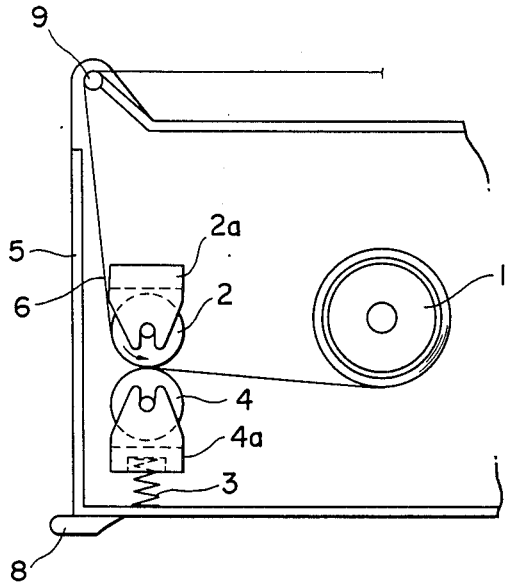
Fig. 1 Prior Art
FIG. 1 is a fragmentary plan view showing the typical prior art ink ribbon feeding mechanism provided in an ink ribbon cassette with its top cover removed.
Figure 2:
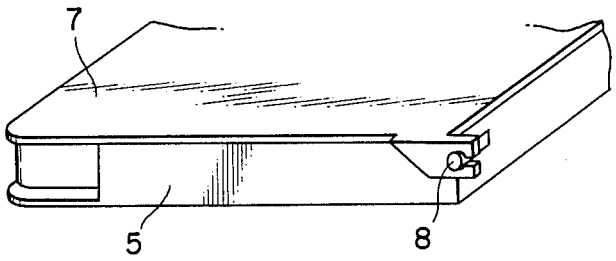
Fig. 2 Prior Art
FIG. 2 is a perspective view showing the general outer look of the prior art cassette.
Figure 3:
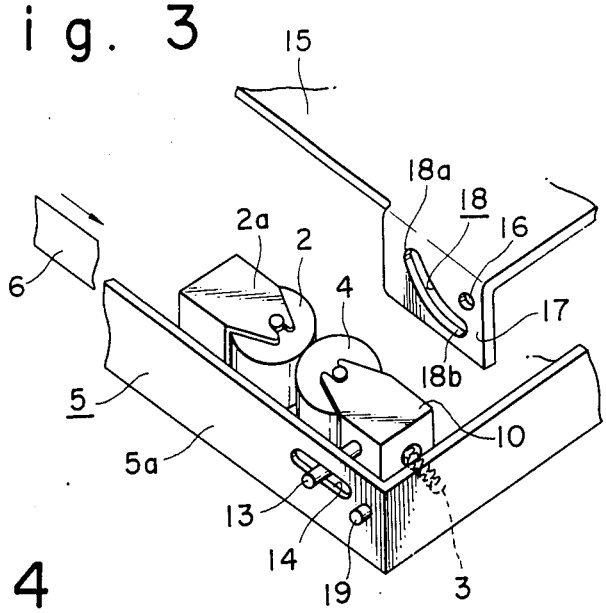
FIG. 3 is a perspective view showing the ink ribbon feeding mechanism constructed in accordance with one embodiment of the present invention.
Figure 4:
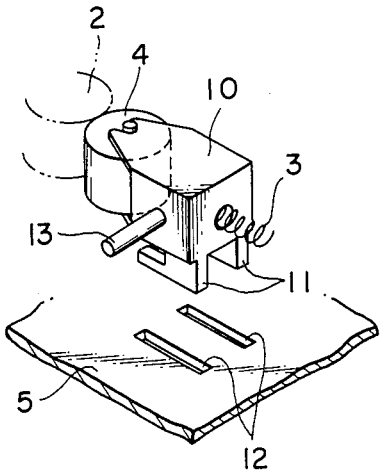
FIG. 4 is a partly exploded view showing the holder for holding the pinch roller constituting part of the structure shown in FIG. 3.

Referring now to FIG. 3, there is shown an ink ribbon feeding mechanism constructed in accordance with one embodiment of the present invention. As shown, the ink ribbon feeding mechanism includes a capstan roller 2 and a pinch roller 4 which are rotatably supported by a stationary holder 2*a* and a movable holder 10, respectively. The stationary holder 2*a* is fixedly attached to an ink ribbon cassette 5 and the movable holder 10 is mounted on the cassette 5 so as to be movable with respect thereto as will be described more in detail later. Also provided is a spring 3 interposed between a side wall of the cassette 5 and the movable holder 10 such that the pinch roller 4 is pressed against the capstan roller 2. In the present embodiment, the movable holder 10 is provided with a pair of guide members 11, 11 at its bottom as shown in FIG. 4. On the other hand, a bottom wall of the cassette 5 is provided with a pair of guide slots 12, 12 in which the guide members 11, 11 of the movable holder 10 may be slidably fitted thereby limiting the direction of sliding motion of the movable holder 10 with respect to the cassette 5.

The movable holder 10 is also provided integrally with a guide projection 13 extending generally horizontally. On the other hand, the cassette 5 has a side wall 5*a* which is provided with a straight guide slot 14 which extends in parallel with the bottom wall of the cassette 5 thereby allowing the movable holder 10 to move closer to or away from the capstan roller 2 as guided by the engagement between the guide members 11, 11 and the guide slots 12, 12. When assembled, the guide projection 13 is slidably fitted in the straight guide slot 14.

The side wall 5*a* of the cassette 5 is also provided with a pivot pin 19 as extending outwardly and located closer to the corner of the cassette 5. A top cover 15, generally rectangular and flat in shape, includes a bracket section 17 which extends vertically downward. It is to be understood that such a bracket section 17 is provided one on each of the opposite sides. The bracket section 17 is provided with a hole 16 into which the pivot pin 19 is fitted when assembled. Thus, the cassette 5 may be closed or opened by pivotally moving the top cover 15 with respect to the cassette 5. The bracket section 17 is also provided with an arcuate slot 18 into which the guide projection 13 may be slidingly fitted when assembled. The arcuate slot 18 is provided such that its top end 18*a* is located further away from the pivot hole 16 as compared with its bottom end 18*b*.

Figure 5:
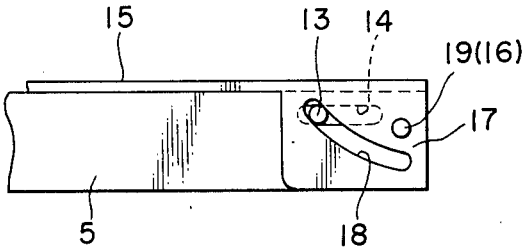
FIGS. 5 and 6 are schematic illustrations which are useful for explaining the operation of the ink ribbon feeding mechanism shown in FIGS. 3 and 4.
Figure 6:
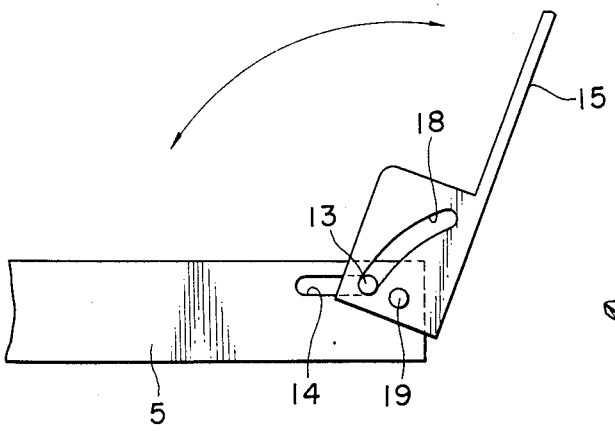

In the embodiment having the above-described structure, when the top cover 15 is assembled to the cassette 5, the guide projection 13, extending beyond the straight guide slot 14, becomes fitted into the arcuate slot 18. Thus, when the top cover 15 is pivoted to its closed position as shown in FIG. 5, the guide projection 13 is forcibly moved toward a forward end of the straight guide slot 14, which is located further away from the pivot pin 19 as compared with the other or rearward end, through the engagement of the guide projection 13 with the straight and arcuate slots 14 and 18. As a result, the pinch roller 4, which is rotatably supported by the movable holder 10, comes to be pressed against the capstan roller 2 under the force of spring 3. On the other hand, when the top cover 15 is pivoted to its open position as illustrated in FIG. 6, the guide projection 13 is forcibly moved toward the rearward end and thus closer to the pivot pin 19 through cooperative engagement with the straight and arcuate slots 14 and 18. As a result, the movable holder 10, together with the pinch roller 4, is moved away from the capstan roller 2 against the force of the spring 3. In this manner, the pinch roller 4 can be brought into and out of pressure contact with the capstan roller 2 automatically simply by pivotally moving the top cover 15 to its closed and open positions, respectively.

Figure 7:
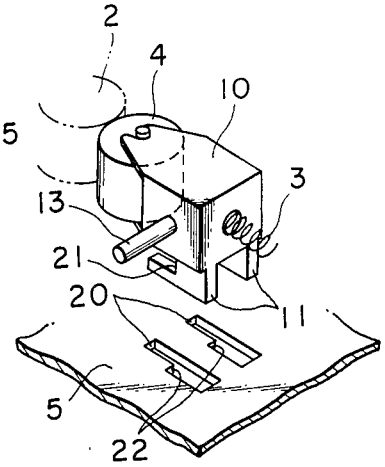
FIG. 7 is a perspective view showing another embodiment of the present invention.
Figure 8:
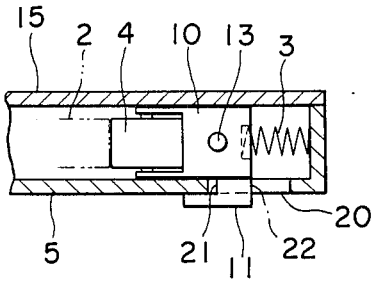
FIG. 8 is a fragmentary cross-sectional view showing the structure in which the movable holder 10 is set in position inside the cassette 5.
Figure 9:
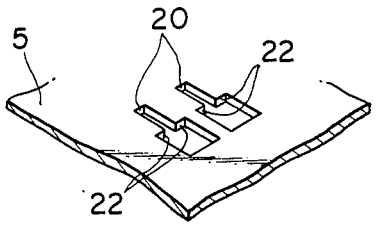
FIG. 9 is a perspective view showing a further embodiment of the present invention.

FIGS. 7 and 8 show another embodiment of the present invention in which each of the guide members 11, 11 depending from the bottom of the movable holder 10 is provided with a stopper section 21 similarly with the previously described embodiment, but a pair of guide slots 20, 20 formed in the bottom wall of the cassette 5 is each provided with a step 22. Thus, when the movable holder 10 is moved in the direction separating away from the capstan roller 2, the stopper sections 21, 21 may be brought into engagement with the respective steps 22, 22. In this embodiment, the step 22 is formed along one side of the guide slot 20. However, such step 22 may be provided one on each side of the guide slot 20 as shown in FIG. 9. It should also be noted that such a combination of guide member 11 and guide slot 12 or 20 may be provided as many as desired and, if desired, a single such a combination may serve the intended purpose.

In the embodiments just described above, the pivotal movement of the top cover 15 is not required by all means. Stated more in detail, it is not necessary for the guide projection 13 to be in sliding engagement with the arcuate guide slot 18. Even if the arcuate guide slot 18 is absent, the guide projection 13 can be moved manually or by any appropriate means in the direction separating away from the capstan roller 2 whereby the stopper sections 21, 21 come to be brought into engagement with the respective steps 22, 22 so that the pinch roller 4 can be kept separated away from the capstan roller 2 without requiring the operator to keep holding the movable holder 10. Since the spring 3 normally biases the movable holder 10 in the direction moving closer toward the capstan roller 2, the holder 10 can be securely held at its retracted position through the engagement between the stopper sections 21, 21 and the steps 20, 20. In order to bring the pinch roller 4 into pressure contact with the capstan roller 2, it is only necessary to push the guide projection 13 sideways thereby releasing the engagement between the stopper sections 21, 21 and the steps 22, 22 since the movable holder 10 can move toward the capstan roller 2 under the force of the spring 3.

Figure 10:
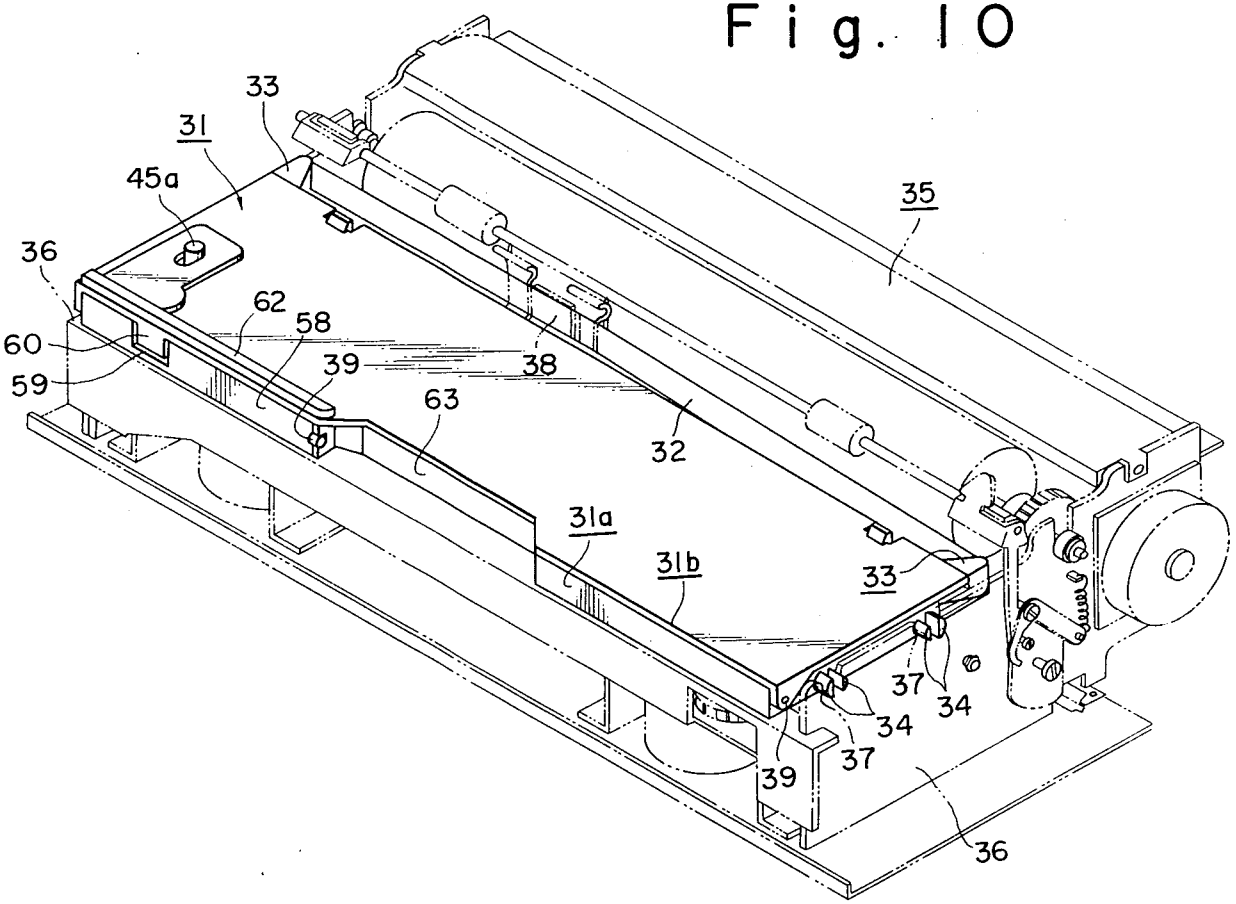
FIG. 10 is a perspective view showing a printer in which an ink ribbon cassette 31 embodying the present invention is detachably mounted.

A still further embodiment of the present invention will be described with reference to FIG. 10, which illustrates the condition in which an ink ribbon cassette 31 embodying the present invention is detachably mounted in a printer 35. The cassette 31 is provided with a pair of guide protuberances 33, 33 located one at each end of its front side, and ink ribbon 32 lead out of the cassette 31 extends between the guide protuberances 33, 33. The cassette 31 is also provided with a pair of engaging projections 34, 34 located on each side thereof, and these engaging projections 34, 34 may be releasably brought into engagement with engaging notches 37, 37 formed at the top end of a frame 36 when the cassette 31 is pushed downward. In this manner, the cassette 31 may be set in position in the printer 35, which is a thermal printer in the illustrated embodiment and thus which includes a thermal printhead 38.

Figure 11:
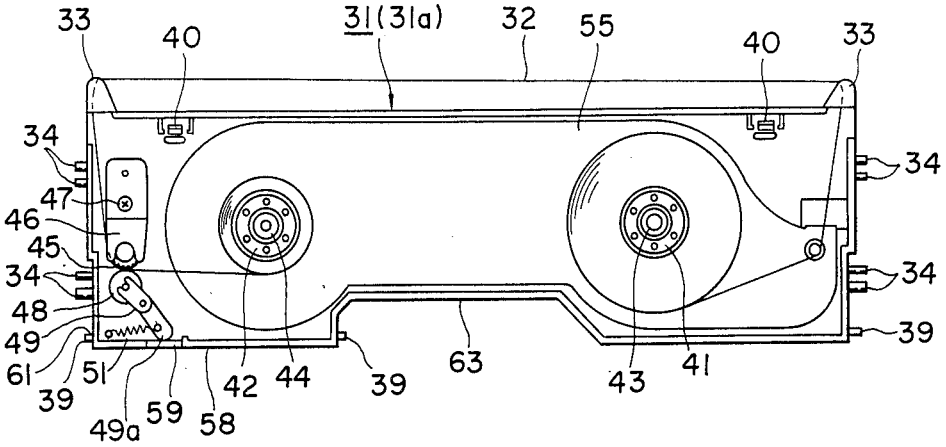
FIG. 11 is a plan view showing the ink ribbon cassette 31 with its top cover removed.
Figure 12:
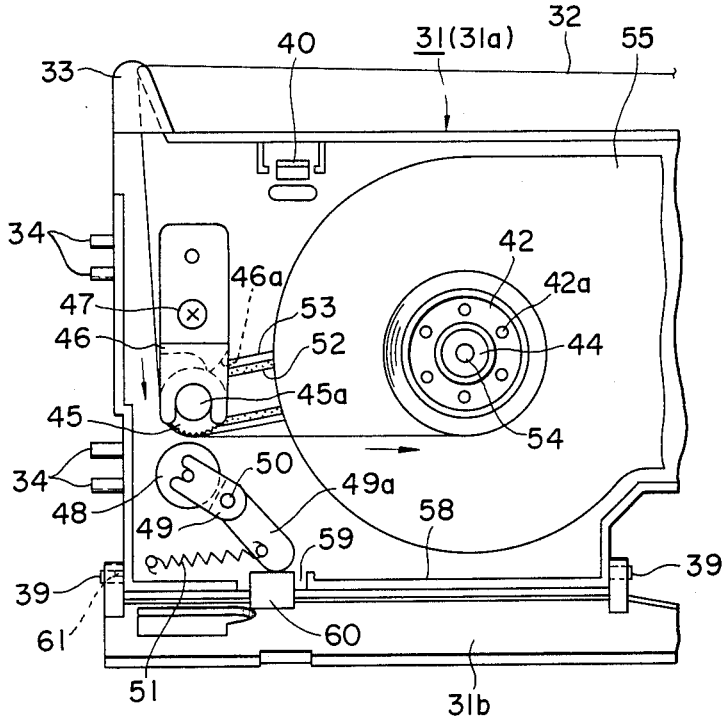
FIG. 12 is a fragmentary plan view showing in detail on an enlarged scale part of the structure shown in FIG. 11.

FIGS. 11 and 12 show the internal structure of the cassette 31 whose main body 31*a* is provided with pivot pins 39 at three different locations. A top cover 31*b* is pivotally supported at the pivot pins 39 so that the top cover 31*b* can be pivotally moved to its closed or open position. In this connection, the cassette main body 31*a* is also provided with a pair of pawls 40, 40 which can keep the top cover 31*b* at its closed position. As best shown in FIG. 11, inside the cassette main body 31*a* is provided a supply spool 41, which is supported on a shaft 43 and holds a supply of ink ribbon 32 wound therearound, and a take-up spool 42, which is supported on a shaft 44 and takes up the ink ribbon 32 after having been used.

The cassette 31 is provided with an ink ribbon feeding mechanism which includes a capstan roller 45, which is rotatably supported by a stationary holder 46 which in turn is fixedly mounted on the bottom wall of the cassette 31 by means of a screw 47, and a pinch roller 48, which is rotatably supported by a movable holder 49 which in turn is pivotally mounted on the bottom wall of the cassette 31 by means of a pin 50. The pivotal holder 49 is integrally provided with an arm 49*a* which extends in the opposite direction with respect to the pin 50. Also provided is a spring 51 with its one end fixedly attached to the arm 49*a* and the other end fixedly attached to the bottom of the cassette 31. Thus, the movable holder 49 is normally biased to pivot clockwise thereby causing the pinch roller 48 to be normally pressed against the capstan roller 45. Thus, the ink ribbon 32 pinched between the capstan roller 45 and the pinch roller 48 may be fed toward the take-up spool 42 when the capstan roller 45 is driven to rotate.

Figure 13:
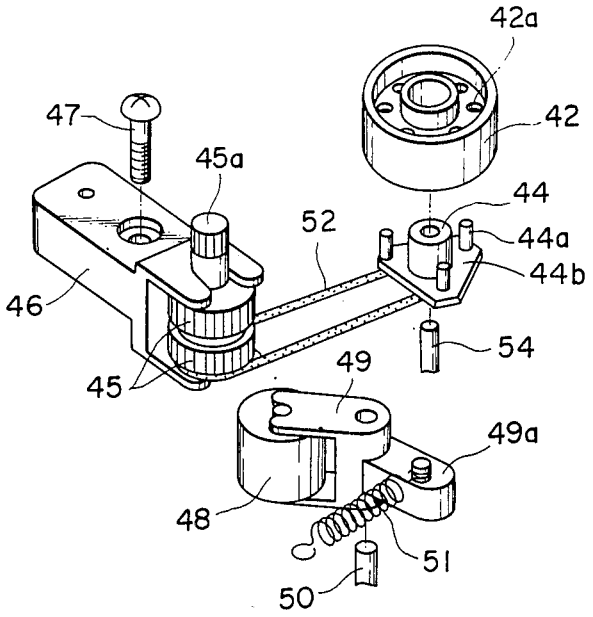
FIG. 13 is an exploded view showing the ink ribbon feeding mechanism provided in the cassette 31.
Figure 14:
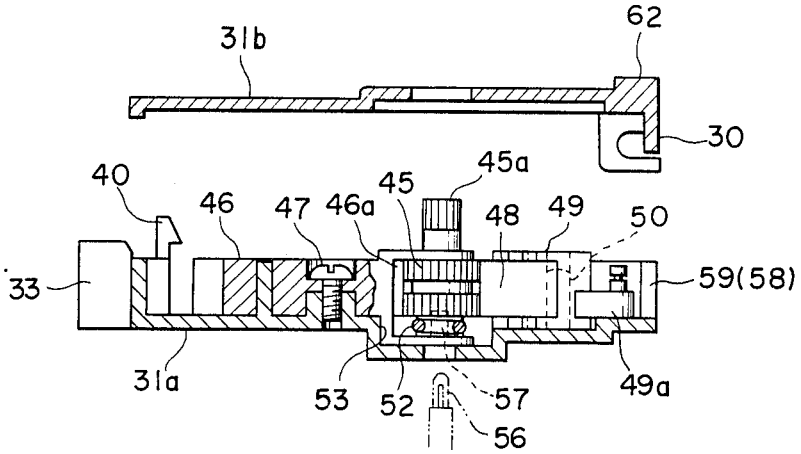
FIG. 14 is a schematic illustration showing the transverse cross-sectional structure of the cassette 31.

As shown FIGS. 12 and 13, the capstan roller 45 is in driving connection with the take-up spool 42 through an endless rubber belt 52, so that the ink ribbon 32 advanced due to the rotation of capstan and pinch rollers 45 and 48 may be immediately wound around the take-up spool 42 without producing any slack. It is to be noted that the belt 52 is located within a recess 53 defined at the bottom wall of the cassette main body 31*a* as best shown in FIG. 14 and the shaft 44 is rotatably supported on a pin 54 which is also located inside of the recess 53. The shaft 44 is fixedly mounted on a generally triangular shaped base plate 44*b* on which is also fixedly provided a plurality of pins 44*a* around the shaft 44. These pins 44*a* may be fitted into receiving holes 42*a* provided in the take-up spool 42 so that the take-up spool 42 becomes integrated with the shaft 44 as far as rotation is concerned. That is, when the shaft 44 is driven to rotate by the capstan roller 45 through the belt 52, the take-up spool 42 also rotates in unison with the shaft 44.

As best shown in FIGS. 11 and 12, an electrically conductive sheet 55 having a defined shape is provided as interposed between the bottom wall of the cassette main body 31*a* and the spools 41 and 42. This conductive sheet 55 serves to prevent the ink ribbon 32 from being electrically charged during operation, for example, due to friction.

A knob 45*a* is integrally provided with the capstan roller 45, and, thus, the operator may grab the knob 45*a* to rotate it thereby causing the capstan roller 45 and the spool 42 to rotate manually. Such a structure is particularly advantageous in such a case where the ink ribbon 32 is set in tension by removing slack therefrom, for example, after installing the ink ribbon 32 in the cassette 31 or the ink ribbon 32 is desired to be advanced over some length. The stationary holder 46 is also provided with a ridged section 46*a* which projects toward the outer peripheral surface of the capstan roller 45 and it serves to prevent the ink ribbon 32 from being wound around the capstan roller 45 during operation. As best shown in FIG. 14, the capstan roller 45 is provided with a connection hole 57 at its bottom, into which a driving shaft 56 of the printer 35 may be automatically fitted when the cassette 33 is set in position in the printer 35. When the driving shaft 56 is fitted into the connection hole 57, the driving shaft 56 and the capstan roller 45 are integrally connected as far as rotation is concerned.

Figure 15:
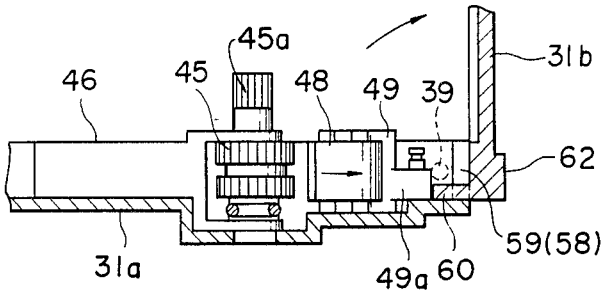
FIG. 15 is a schematic illustration which is useful for explaining the operation of the cassette 31.

The cassette main body 31*a* includes a side wall 58 which is formed with a window 59 corresponding in position to the arm 49*a* of pivotal holder 49 which rotatably holds the pinch roller 48. The top cover 31*b* is provided with a tongue section 60 at its rearward end, which may be fitted into the window 59 when the top cover 31*b* is pivoted open. Described more in detail in this respect, when the top cover 31*b* is located at its closed position, the tongue section 60 extends vertically downward or in parallel with the upright side wall 58; whereas, when the top cover 31*b* is pivoted around the pin 39 to be located at its open position, the tongue section 60 is moved into the window 59 to engage with the arm 49*a* thereby causing the holder 49 to rotate in the counterclockwise direction around the pin 50 against the force of the spring 51, as indicated in FIG. 15. Thus, the opening of the top cover 31*b* causes the pivotal holder 49 to rotate counterclockwise around the pin 50 so that the pinch roller 48 is moved as separated away from the capstan roller 45. Such being the case, the ink ribbon 32 can be easily set in position or removed from the cassette 31.

Figure 16:
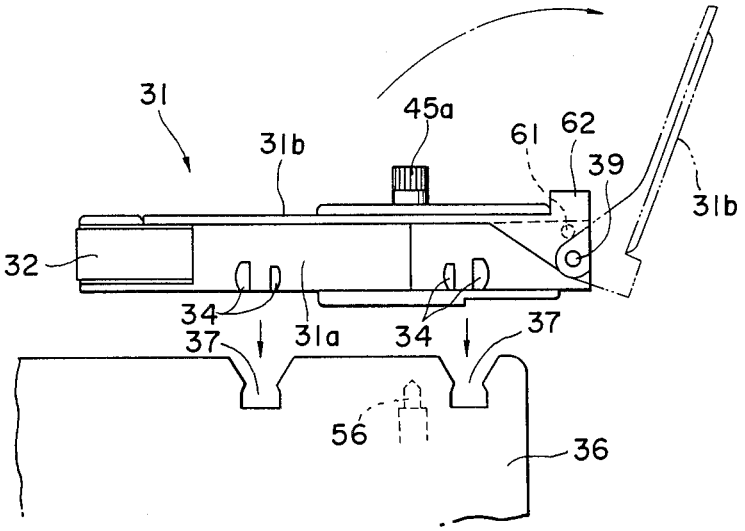
FIG. 16 is a schematic illustration showing how the cassette 31 may be detachably mounted in position in a printer.

As shown in FIGS. 11, 15 and 16, it is preferable to provide a click stopper 61 on the cassette 31 thereby allowing the top cover 31*b* to be maintained at its open position. In the illustrated embodiment, the pivot pin 39 is additionally provided at the midway location of the cassette main body 31*a* and the top cover 31*b* is provided with a rib structure 62 in the vicinity of the tongue section 60 thereby allowing the tongue section 60 to impart a pressing force to the holder 49 without failure. It is also to be noted that a dent 63 is provided in the cassette 31 so as to allow the operator to easily grab the cassette 31.

Figure 17:
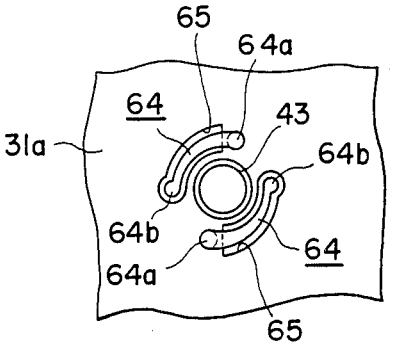
FIGS. 17 and 18 are schematic illustrations showing a structure for imparting a resistive force against the rotation of the supply spool when the spool rotates to unwind the ink ribbon.
Figure 18:
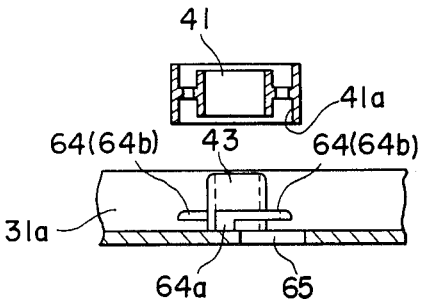

FIGS. 17 and 18 show a structure for applying a resistive force to the supply spool 41 against its rotation when the ink ribbon 32 is unwound therefrom. The resistive force applying structure includes a pair of braking members 64, 64, each of which includes a base portion 64*a* which is integrally connected to the bottom wall of the cassette main body 31*a* and a flexible arm 64*b* which extends around the shaft 43 over some distance. When the supply spool 41 is fitted onto the shaft 43, the tip end of the arm 64*b* comes to be pressed against an inner peripheral surface 41*a* of the supply spool 41. Due to this pressure contact between the braking members 64 and the supply spool 41, the supply spool 41 can be prevented from overrotating when the ink ribbon 32 is intermittently unwound from the supply spool 41. The bottom wall of the cassette main body 31*a* is also provided with a pair of relief holes 65, 65 corresponding in position and shape to the respective braking members 64, 64.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. An ink ribbon feeding mechanism comprising:

a housing provided with first guide means extending over a distance to define a predtermined path;

a first roller;

first holding means for rotatably holding said first roller fixed in position;

a second roller;

second holding means for rotatably holding said second roller, said second holding means being movable along said predetermined path so as to bring said second roller into or out of contact with said first roller and including at least one guide member engageable with said first guide means so that said second holding means is movable along said first guide means;

biasing means for normally biasing said second holding means in a predetermined direction along said predetermined path such that said second roller is pressed against said first roller with ink ribbon to be fed being sandwiched therebetween;

means for keeping said second holding means at a retracted position along said predetermined path thereby allowing to keep said second holding means separated away from said first roller; and a top cover pivotally connected to said housing and provided with a bracket section, whereby said keeping means includes a guide projection integrally provided on said second holding means, a straight guide slot formed in said housing as extending straight and an arcute guide slot formed in said bracket section, said guide projection extending through said straight and arcuate guide slots thereby allowing to move said second holding means along said first guide means to move said second roller to be in contact with or separate away from said first roller automatically when said top cover is pivoted closed or open.

2. The mechanism of claim 1 wherein said first guide means includes at least one slot formed in said housing and said at least one guide member is slidably fitted in said slot.

3. The mechanism of claim 2 wherein said keeping means includes a stopper section formed in said at least one guide member and a step formed along one side of said at least one slot, whereby said second holding means can be maintained at said retracted position through engagement between said stopper section and said step.

4. The mechanism of claim 3 wherein said step is formed one on each side of said at least one slot.

5. The mechanism of claim 1 wherein said housing is an ink ribbon cassette, said first roller is a capstan roller and said second roller is a pinch roller.

6. An ink ribbon cassette comprising:

a main body generally in the form of a top open rectangular box;

a top cover pivotally connected to said main body;

a supply spool rotatably mounted on said main body, a supply of ink ribbon being wound around said supply spool;

a take-up spool rotatably mounted on said main body spaced apart from said supply spool, said take-up spool taking up said ink ribbon after advancing along a predetermined path as unwound from said supply spool;

a first roller rotatably supported on said main body fixed in position;

a second roller which is movable in position and which may be pressed against said first roller with said ink ribbon sandwiched therebetween thereby allowing said ink ribbon to be fed toward said take-up roller when at least one of said first and second rollers is driven to rotate in a predetermined direction;

keeping means for selectively keeping said second roller at a first position where said second roller is pressed against said first roller when said top cover is pivoted closed or at a second position where said roller is separate away from said first roler when said top cover is pivoted open, said keeping means including a movable holder which holds said second roller rotatably and is movable along a predetermined path so as to bring said second roller into or out of contact with said first roller;

couping means for operatively coupling said first roller and said take-up spool, so that said first roller is connected to an exterior driving source when said cassette is set in position; and said main body including a bottom wall and a peripheral wall which extends upright from the perhipheral edge of said bottom wall, said side wall being provided with a window corresponding in location to said movable holder, said top cover being provided with a tongue which may be brought into engagement with said movable holder through said window when said top cover is pivoted open.

7. The cassette of claim 6 wherein said movable holder is pivotally supported on said main body and biasing means is provided on said main body to bias said movable holder in a predetermined direction tending to bring said second roller into pressure contact with said first roller.

* * * * *